US010887966B2

(12) United States Patent
Ma et al.

(10) Patent No.: US 10,887,966 B2
(45) Date of Patent: Jan. 5, 2021

(54) METHODS AND APPARATUS TO REDUCE A COUPLING EFFECT IN AN LED DISPLAY

(71) Applicant: TEXAS INSTRUMENTS INCORPORATED, Dallas, TX (US)

(72) Inventors: Jun Ma, Shanghai (CN); Shuxiao Xu, Guangdong (CN); Minwen Shi, Shanghai (CN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/200,314

(22) Filed: Nov. 26, 2018

(65) Prior Publication Data

US 2020/0022229 A1 Jan. 16, 2020

Related U.S. Application Data

(63) Continuation of application No. PCT/CN2018/095645, filed on Jul. 13, 2018.

(51) Int. Cl.
*H05B 45/00* (2020.01)
*H05B 45/48* (2020.01)
*H05B 45/10* (2020.01)

(52) U.S. Cl.
CPC ..... *H05B 45/48* (2020.01); *H05B 45/10* (2020.01)

(58) Field of Classification Search
CPC ..... H05B 37/02; H05B 37/0218; H05B 37/0227; H05B 37/0272; H05B 33/08; H05B 33/0815; H05B 33/0842; H05B 33/0845; H05B 33/0854; H05B 33/0883; H05B 45/00; H05B 45/10; H05B 45/48; H05B 47/00; H05B 47/10
See application file for complete search history.

(56) References Cited

U.S. PATENT DOCUMENTS

2012/0256971 A1 10/2012 Shin et al.
2016/0119989 A1* 4/2016 Codutti ..... H03K 3/017 315/77

FOREIGN PATENT DOCUMENTS

CN 102915695 A 2/2013
CN 103578412 A 2/2014
CN 104021760 A 9/2014
(Continued)

OTHER PUBLICATIONS

Search Report for PCT Application No. PCT/CN2018/095645, international search report dated Apr. 16, 2019, 2 pages.
(Continued)

*Primary Examiner* — Jimmy T Vu
(74) *Attorney, Agent, or Firm* — Mark Allen Valetti; Charles A. Brill; Frank D. Cimino

(57) ABSTRACT

Methods and apparatus to reduce a coupling effect in a light emitting diode (LED) display are disclosed. An example LED display includes an array of LEDs, and a line controller to select a line of LEDs of the array of LEDs for illumination. The example LED display wall includes a column controller to control illumination of at least two of the LEDs of the line of LEDs. The column controller is to cause, when the first brightness value is less than a threshold, a first LED to be illuminated during a first time period and a second LED to be illuminated during a second time period. The second period is distinct from the first time period. The first LED is a different color than the second LED.

22 Claims, 13 Drawing Sheets

(56) References Cited

FOREIGN PATENT DOCUMENTS

| | | | |
|---|---|---|---|
| CN | 104318893 | A | 1/2015 |
| CN | 107507560 | A | 12/2017 |

OTHER PUBLICATIONS

CN107507560A, machine translation, 11 pages, (dated Jul. 8, 2019).
CN104318893A, machine translation, 17 pages, (dated Jul. 8, 2019).
CN104021760A, machine translation, 13 pages, (dated Jul. 8, 2019).
CN103578412A, machine translation, 24 pages, (dated Jul. 8, 2019).
CN102915695A, machine translation, 12 pages, (dated Jul. 8, 2019).

* cited by examiner

METHODS AND APPARATUS TO REDUCE A COUPLING EFFECT IN AN LED DISPLAY

FIELD OF THE DISCLOSURE

This disclosure relates generally to light emitting diode (LED) displays, and, more particularly, to methods and apparatus to reduce a coupling effect in an LED display.

BACKGROUND

In recent years, light emitting diode (LED) display walls have become a more common form of display. Uses for display walls include, for example, billboards, theaters, marketing displays, etc. LED display walls have even become more commonplace in small-pitch indoor locations, such as home theaters.

DETAILED DESCRIPTION

As the small-pitch indoor market grows for light emitting diode (LED) display walls, so does the demand for better performance of such display walls. Many display walls have issues such as, for example, ghosting, color shifting, etc. Many of those issues have been remedied or mitigated by existing display technologies. One issue that still remains in such systems, however, is a coupling issue, where LEDs within the LED array are coupled brighter or darker based on the output values of other nearby LEDs (e.g., LEDs within a same line).

Figure 1:
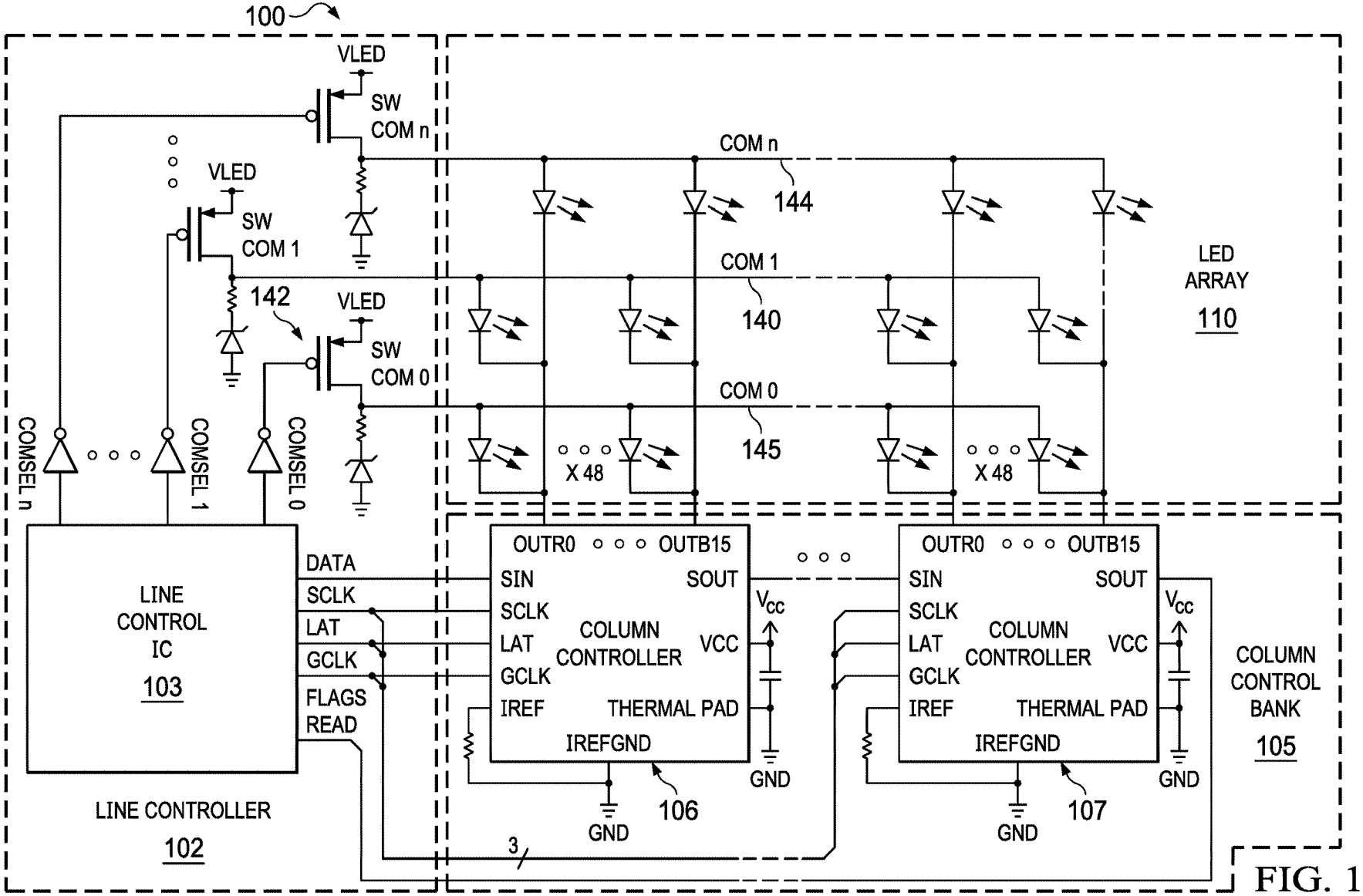
FIG. 1 is an example implementation of an LED display wall.

FIG. 1 is an example implementation of an LED display wall 100. The example LED display wall 100 of FIG. 1 includes a line controller 102, a column control bank 105, and an LED array 110. In the illustrated example of FIG. 1, the LED array 110 includes a plurality of LEDs arranged in a grid. However, in some examples, any other arrangement of LEDs may additionally or alternatively be used. In the illustrated example of FIG. 1, the line controller 102 includes a line control integrated circuit (IC) 103. The line control ID 103 is connected to additional components such as, for example, diodes and/or transistors to enable selection of a particular line for illumination.

In the illustrated example of FIG. 1, the example line control IC 103 is implemented by a hardware logic circuit. However, any other type of circuitry may additionally or alternatively be used such as, for example, one or more analog or digital circuit(s), logic circuits, programmable processor(s), Application Specific Integrated Circuit(s) (ASIC(s)), Programmable Logic Device(s) (PLD(s)), Field Programmable Logic Device(s) (FPLD(s)), Digital Signal Processor(s) (DSP(s)), etc. The example line control IC 103 controls which line is to be illuminated by the column control bank 105.

The example column control bank 105 includes a plurality of column controllers 106, 107. Each of the column controllers 106, 107 drives one or more columns of LEDs of the LED array 110. In the illustrated example of FIG. 1, each column controller 106, 107 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc.

In the illustrated example of FIG. 1, each column controller drives forty-eight columns of LEDs corresponding to three sets of sixteen LEDs. Each of the sets of LEDs includes three colored LEDs, including, for example a red LED, a green LED, and a blue LED. However, any other number of columns having any other color may be driven. Moreover, while in the illustrated example of FIG. 1, two column controllers are shown, any number of column controllers may additionally or alternatively be used.

In the illustrated example of FIG. 1, when a particular line is chosen for illumination (e.g., Line COM1 140), the chosen line is shorted to a voltage VLED 142 by the line control IC 103. Other unchosen lines (e.g., COMn 144, COM0 145) are connected to corresponding Zener diodes through corresponding resistors by the line control IC 103. One example approach to diminishing the coupling is achieved through line control. Using such an approach, unchosen lines are connected to a fixed voltage, instead of being allowed to float. Using such an approach, coupling paths among different lines are diminished. However, such coupling may still exist within the same line.

Figure 2:
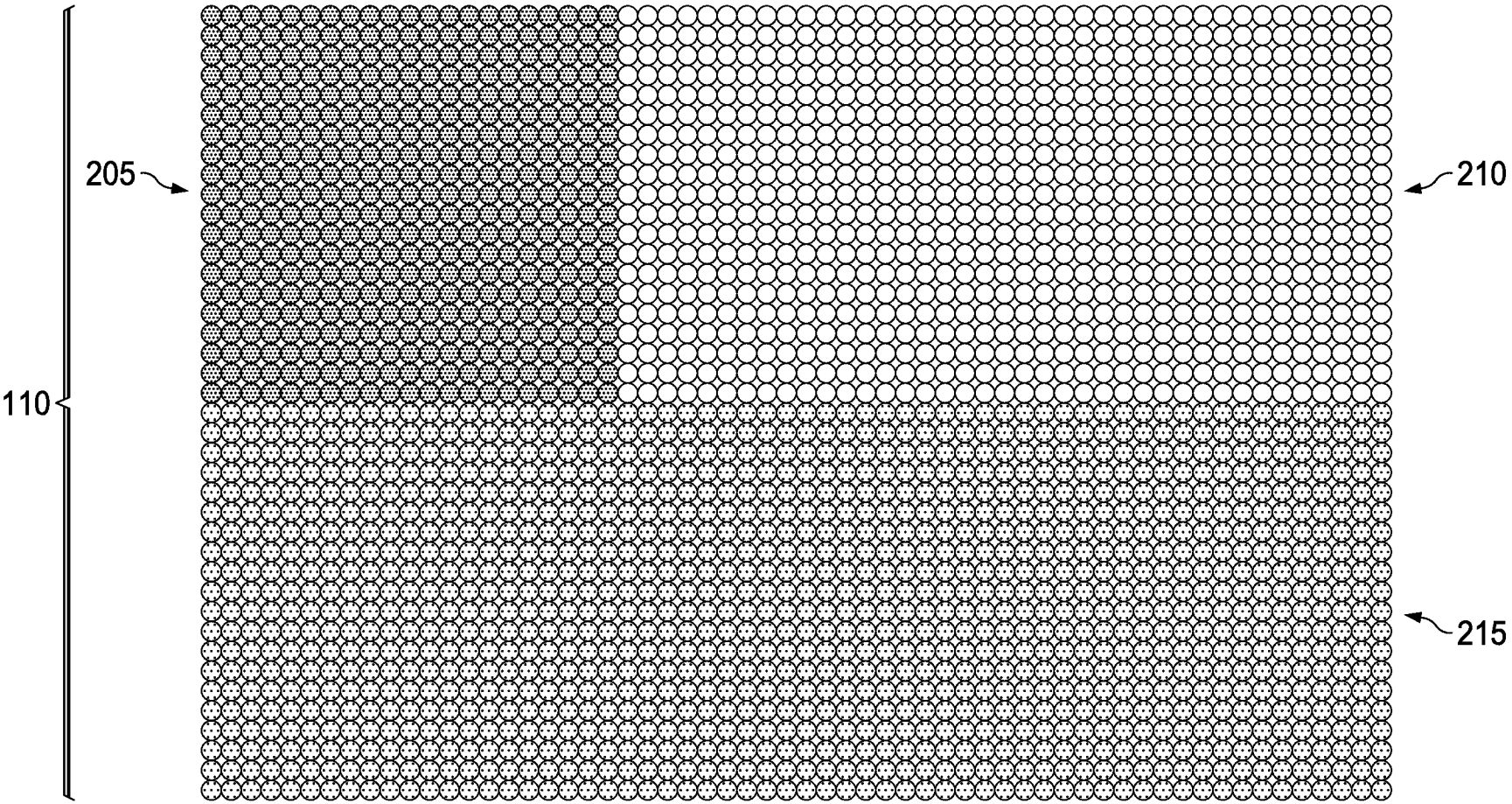
FIGS. 2 and 3 are diagrams representing example LED display walls outputting images with a coupling effect.
Figure 3:
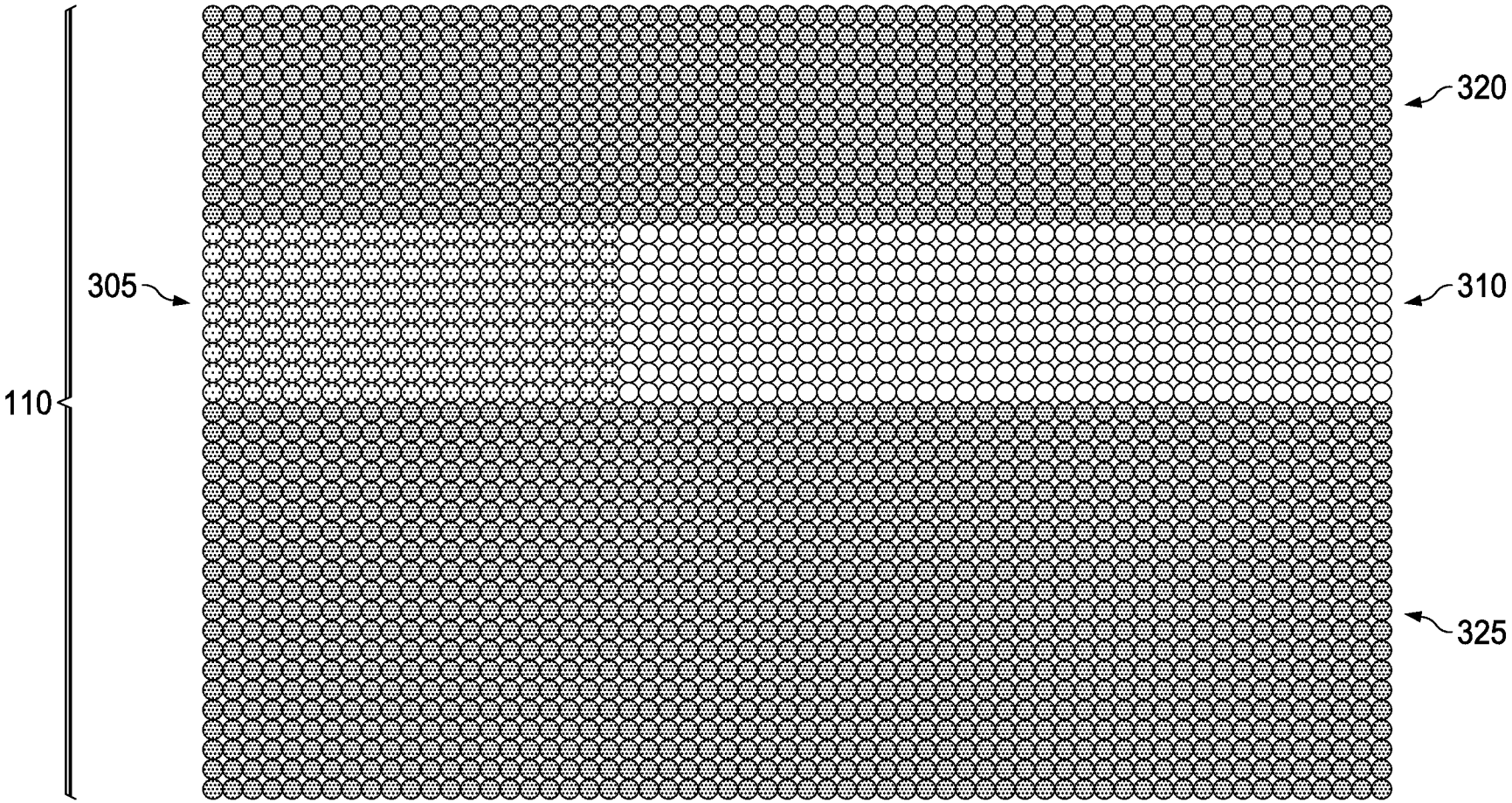

In such an example, transitions among each of the LEDs cause coupling effects that can result in distorted displayed images. FIGS. 2 and 3 are diagrams representing example LED display walls outputting images with a coupling effect. In the illustrated example of FIG. 2, a first section 205 is displayed on the same lines of the LED array 110 as a second section 210. In the illustrated example of FIG. 2, the first section 205 is coupled darker. A third section 215 that is not displayed on the same lines as the first section 205 or the second section 210 does not exhibit the coupling effect.

In the illustrated example of FIG. 3, a first section 305 and a second section 310 are displayed on the same lines of the LED array 110. The first section 305 is coupled lighter as a result of the coupling effect. A third section 320 and a fourth section 325 do not share the same lines as the first section 305 or the second section 310 and, as a result, do not exhibit the coupling effect.

Figure 4:
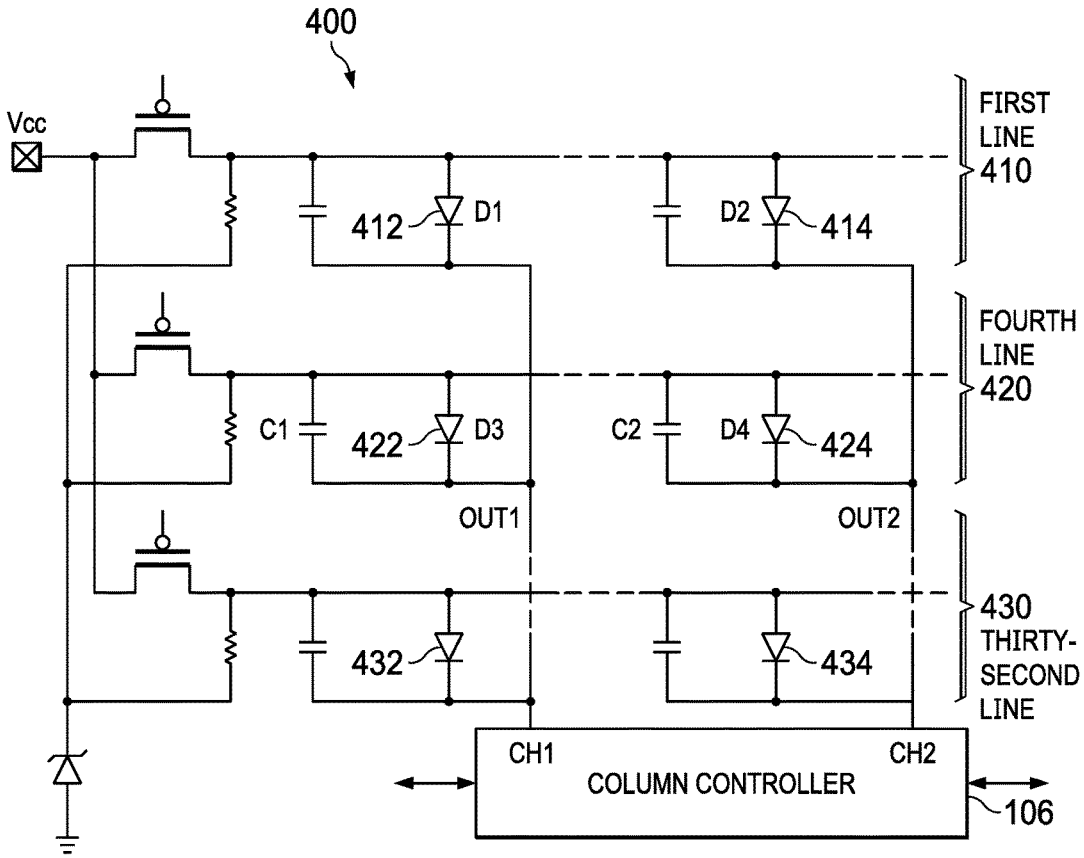
FIG. 4 is a circuit diagram of an example LED display wall connected to the column controller of FIG. 1.

FIG. 4 is a circuit diagram of an example LED display wall connected to the column controller 106. In the illustrated example of FIG. 4, a first line 410 is shown and includes a first LED 412 and a second LED 414. A second line 420 includes a third LED 422 and a fourth LED 424. A third line 430 includes a fifth LED 432 and a sixth LED 434. In the illustrated example of FIG. 4, the second LED 414 is intended to display a high grayscale value (e.g., a high brightness), while the first LED 412, the third LED 422, and the fourth LED 424 are intended to display a same low grayscale value (e.g., a low brightness).

Figure 5:
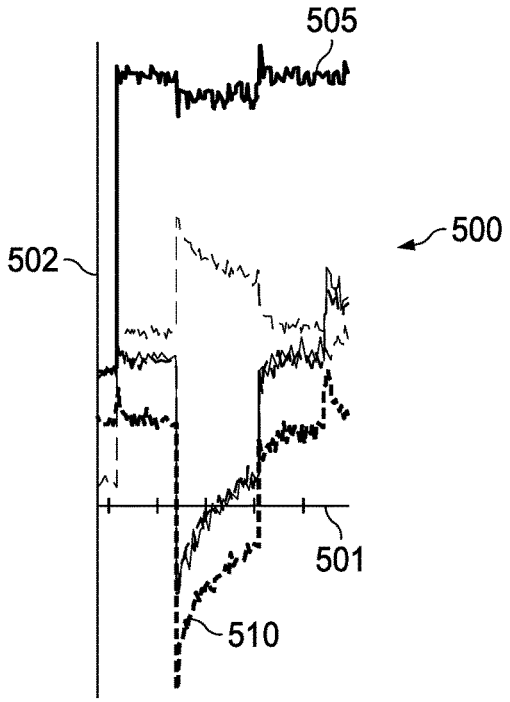
FIG. 5 is a timing diagram representing voltages of the circuit diagram of FIG. 4 when illuminating the LEDs of the first line of FIG. 4.

FIG. 5 is a timing diagram representing voltages across various locations in the circuit diagram of FIG. 4 when illuminating the LEDs of the first line of FIG. 4. In the illustrated example of FIG. 5, a horizontal axis 501 represents time, and a vertical axis 502 represents voltage. A first waveform 505 corresponds to the line enable waveform for the first line 410 of FIG. 4. In the illustrated example of FIG. 5, the first waveform goes from a low value to a high value, indicating that the first line has been selected. A second waveform 510 indicates a voltage across the first LED 412.

Figure 6:
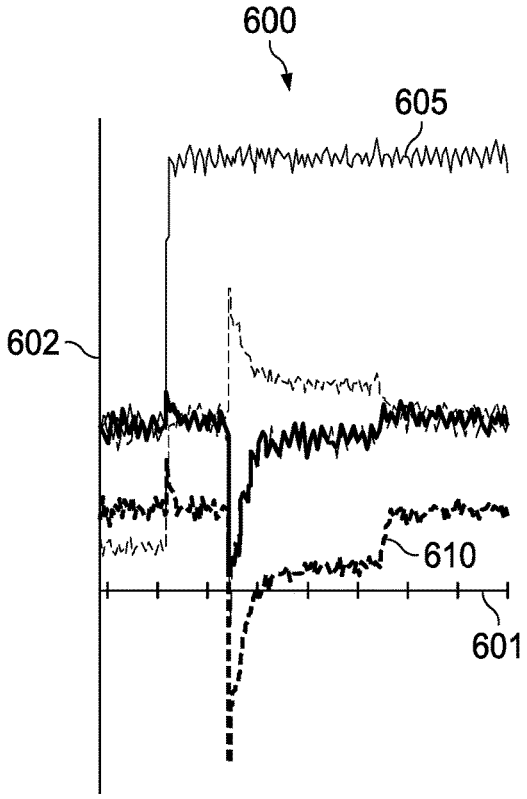
FIG. 6 is a timing diagram representing voltages of the circuit diagram of FIG. 4 when illuminating the LEDs of the second line of FIG. 4.

FIG. 6 is a timing diagram representing voltages across various locations in the circuit diagram of FIG. 4 when illuminating the LEDs of the second line of FIG. 4. In the illustrated example of FIG. 6, the horizontal axis 601 represents time, and the vertical axis 602 represents voltage. A first waveform 605 corresponds to the line enable waveform for the second line 420 of FIG. 4. In the illustrated example of FIG. 6, the first waveform goes from a low value to a high value, indicating that the first line has been selected. A second waveform 610 indicates a voltage across the third LED 422.

Recall that in the illustrated example of FIG. 4, the second LED 414 was to have a high grayscale value, while the first LED 412, the third LED 422, and the fourth LED 424 were to have a same low grayscale value. In the illustrated example of FIG. 5, the first LED 412 (represented by the second waveform 510) exhibits coupling (e.g., a different output value than the intended output value). In contrast, in the illustrated example of FIG. 6, the third LED 422 (represented by the second waveform 610) does not exhibit coupling. If, for example, the first LED did not exhibit coupling, the waveforms of FIGS. 5 and 6 would match.

Figure 7:
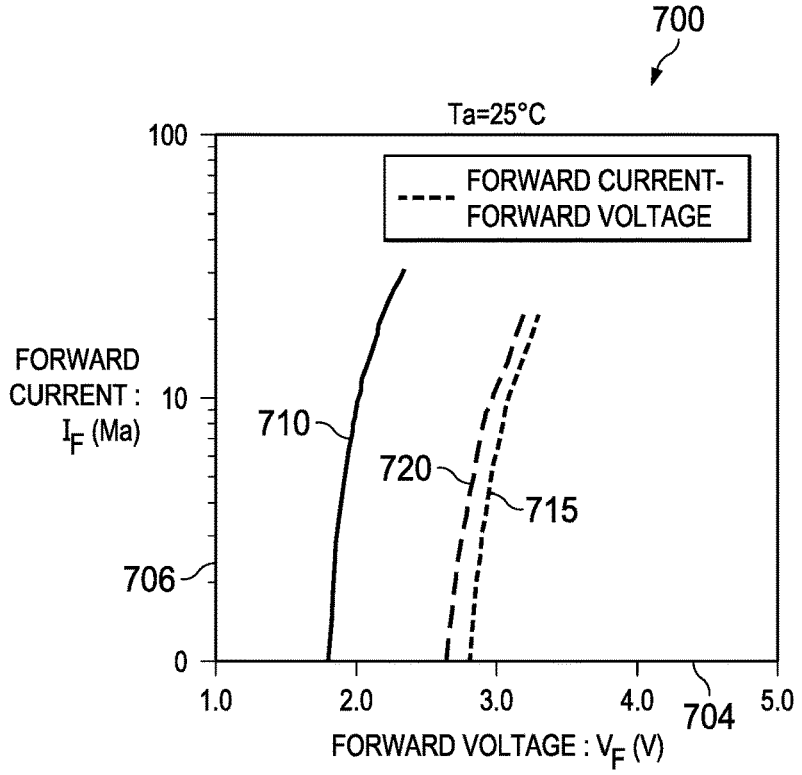
FIG. 7 is a diagram showing forward current and forward voltages for red, green, and blue LEDs.

FIG. 7 is a diagram showing forward current and forward voltages for red, green, and blue LEDs. In the illustrated example of FIG. 7, the horizontal axis 704 represents voltage, and the vertical axis 706 represents current. A first curve 710 corresponds to a red LED, and shows that the voltage drop is approximately 2 volts. A second curve 715 corresponds to a green LED, and shows that the voltage drop is approximately 3 volts. A third curve 720 corresponds to blue LED, and shows that the voltage drop is approximately 3 volts. Parasitic capacitances of the red, green, and blue LEDs are approximately 30 picofarad, 60 picofarad, and 60 picofarad, respectively. In some examples, because any given column channel output by the column controller 106 is used to drive LEDs from multiple different lines, the parasitic capacitance for any given column channel output may be several hundred picofarads. Because of the higher capacitances of the green and blue LEDs, larger coupling paths and resultant coupling effects exist. In examples disclosed herein, the column channel has to pull down the LED voltage to reach a working (e.g., illuminated) point.

As a result, additional charge (based on the parasitic capacitance and the voltage drop) is to be compensated for. In examples disclosed herein, such compensation is achieved using a one-shot function. To illuminate a red LED, the one-shot function pulls down the voltage by 800 millivolts. In contrast, to illuminate a blue or green LED, the one-shot function must pull down the voltage by 1.2 volts.

Example approaches disclosed herein recognize that an equivalent capacitance of a non-selected line varies depending on whether other lines are left floating, or are set to a fixed voltage. When other lines are left floating during times of non-conduction, the equivalent capacitance is 2 C. When other lines are set to a fixed voltage (e.g., during pre-charging or normal conducting), the equivalent capacitance is 16 C. In the case of blue and green LEDs, where capacitances are approximately 60 picofarad, equivalent capacitances can approach 1 nanofarad.

Figure 8:
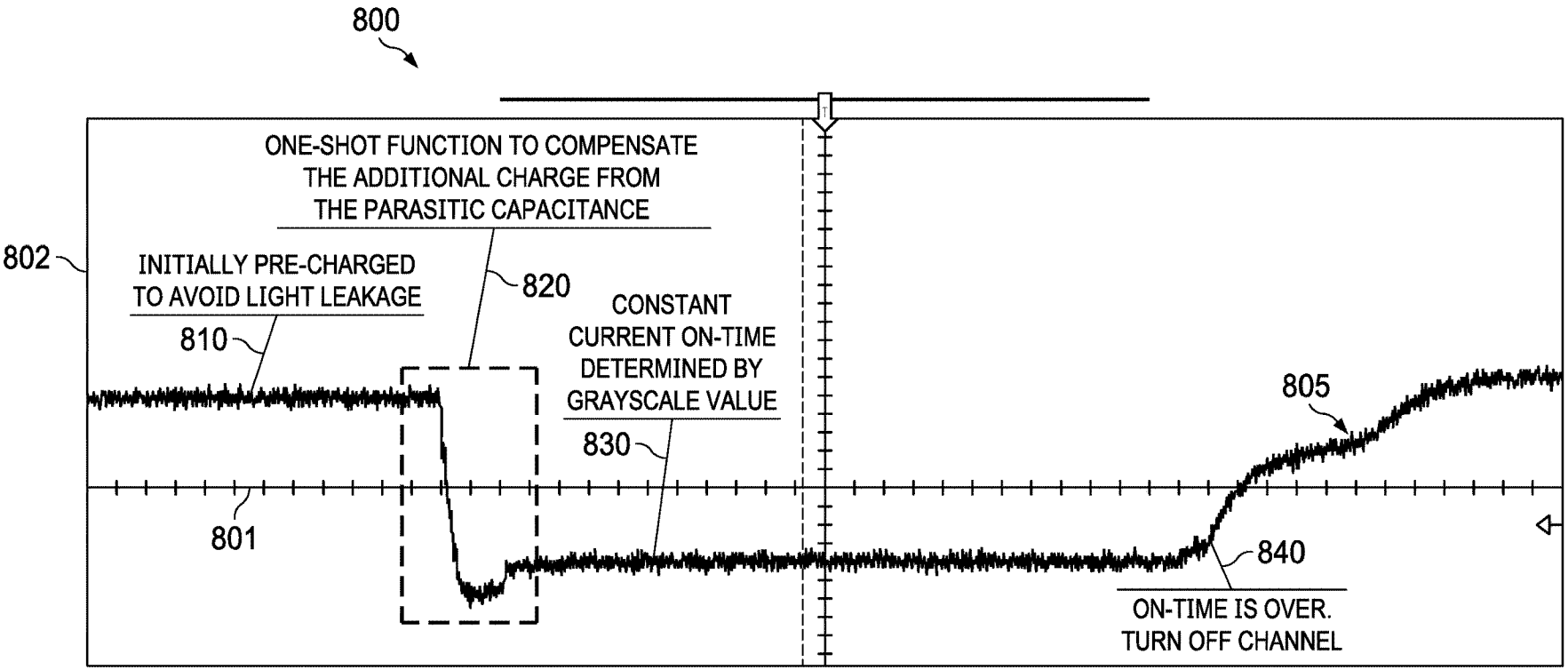
FIG. 8 is a diagram illustrating an example waveform used to illuminate an LED.

FIG. 8 is a diagram 800 illustrating an example waveform 805 used to illuminate an LED. The example diagram 800 includes a horizontal axis 801 representing time, and a vertical axis 802 representing voltage. The example waveform 801 includes a first section 810, where the LED is pre-charged. Pre-charging of the LED is used to avoid light leakage. The example waveform 805 includes a second section 820, where the one-shot function is applied to compensate for the additional charge from the parasitic capacitance experienced at the LED. The example waveform 805 includes a third section 830, where the LED is held at a constant current and/or voltage. The length of on-time of the third section 830 is based on the grayscale value that is to be output by the LED. Larger grayscale values result in longer on-times for the third period. Conversely, smaller grayscale values result in shorter on-times for the third period. The example waveform 805 includes a fourth section 840 where, after the corresponding on-time duration (of the third section 830) is reached, the LED is turned off.

Figure 9:
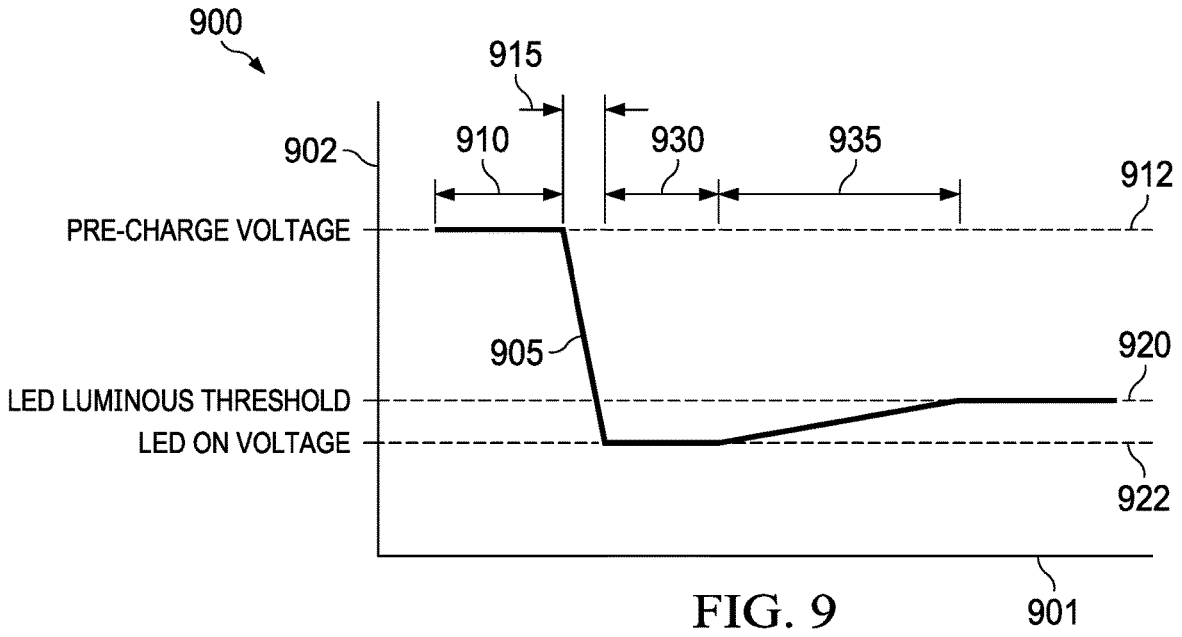
FIG. 9 is a diagram illustrating an example waveform used to illuminate an LED.

FIG. 9 is a diagram 900 illustrating an example waveform 905 used to illuminate an LED. The example diagram 900 includes a horizontal axis 901 representing time, and a vertical axis 902 representing voltage. At a first time period 910, the waveform 905 is held at a pre-charge voltage 912. In a second time period 915, a one-shot function is applied to illuminate the LED. To illuminate the LED, the voltage is pulled down past an LED luminous threshold 920 to reach an LED on voltage 922. In a third time period 930, the LED is held at the LED on voltage 922 for an amount of time based on the grayscale value to be output by the LED. In a fourth time period 935, the LED is no longer to be illuminated and the channel is turned off. However, a tail charge exists that keeps the LED illuminated until the voltage across the LED reaches the LED luminous threshold 920. The tail charge is based on a parasitic capacitance across the LED and a difference between the LED luminous threshold 920 and the LED on voltage 922. If other channels are floating, the parasitic capacitance is smaller, resulting in a smaller tail charge. If other channels are fixed, the parasitic capacitance is larger, resulting in a larger tail charge.

Figure 10:
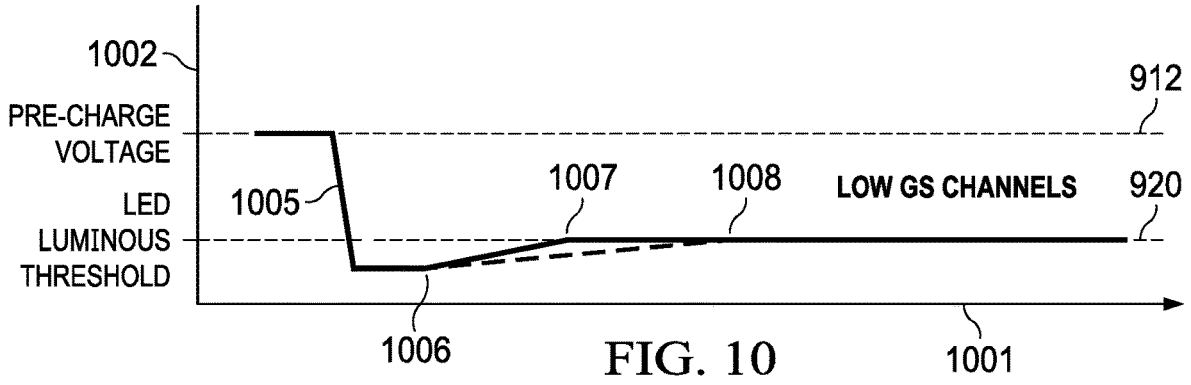
FIG. 10 is a diagram illustrating an example waveform that is coupled brighter.

FIG. 10 is a diagram 1000 illustrating an example waveform 1005 that is coupled brighter. The example diagram 1000 of FIG. 10 includes a horizontal axis 1001 representing time, and a vertical axis 1002 representing voltage. In the illustrated example of FIG. 10, a one-shot function is applied to the waveform to take the voltage across the LED from the pre-charge voltage 912 to below the LED luminous voltage 920. Because the grayscale value for the example waveform is small, at point 1006 (a short duration of time after the one-shot function is applied), the channel is turned off and the voltage across the LED is allowed to float, thereby experiencing the tail charge. If, for example, all of the LEDs of a given line are to be being illuminated using a same low grayscale value (e.g., those LEDs all reach point 1006 at approximately the same time), the tail charge will be the same across the line, resulting in each of the LEDs for that line reaching the LED luminous threshold 920 at a same time. However, when different values are to be output by each of the LEDs in a given line, the tail charge can be affected by the varied capacitances caused by the other LEDs still being illuminated. Thus, for example, instead of the LED being illuminated until point 1007 being reached, the LED might be illuminated until point 1008 is reached (e.g., may be illuminated for a longer period of time). As a result, the output brightness is greater than intended, causing coupling effects to become visible in the display.

To mitigate the effects of the tail charge, in some examples, a pre-charge (e.g., a reverse one-shot function) may be applied at the end of the illumination to quickly de-illuminate the LED. However, such an approach might, in some examples, have the unintended consequence of resulting in a darkened coupling effect.

Figure 11:
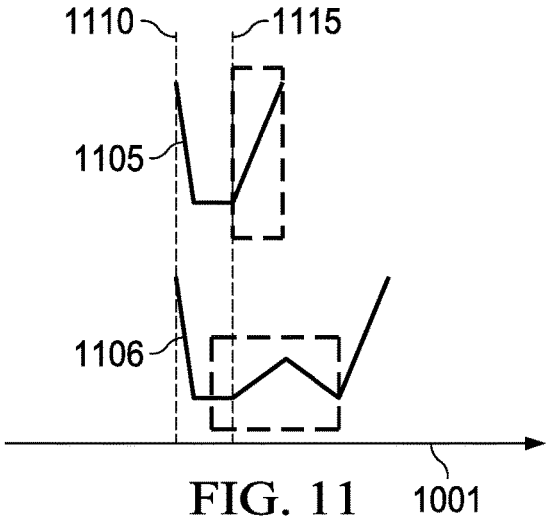
FIG. 11 is a diagram illustrating example waveforms that illustrate a darker coupling effect.

FIG. 11 is a diagram 1100 illustrating example waveforms 1105, 1106 illustrating a darker coupling effect. FIG. 11 includes a horizontal axis representing time. In the illustrated example of FIG. 11, a first waveform 1105 is to result in a first LED of a given line outputting a low grayscale value, and a second waveform 1106 is to result in a second LED of the given line outputting a grayscale value greater than the low grayscale value. At a first time 1110, a one-shot function is applied to illuminate the first LED and the second LED. At a second time 1115, a reverse one-shot function is applied to de-illuminate the first LED. While the reverse one-shot function is applied to the first LED, the voltage across the second LED is pulled up, resulting in the second LED being coupled darker.

In some examples, other approaches to mitigating the effects of the tail charge may be used. For example, the one-shot function for low grayscale channels may be delayed, resulting in the tail charges occurring at the same time for the line. However, such an approach may, in some examples, result in darker coupling as the one-function to illuminate the LED may be impacted by the conduction of other higher grayscale channels. In some other examples, all channels may be left floating prior to conduction. However, when a low grayscale channel is illuminated, its load is still fixed (e.g., other higher grayscale channels are conducting), resulting in the low grayscale channel being coupled darker.

Figure 12:
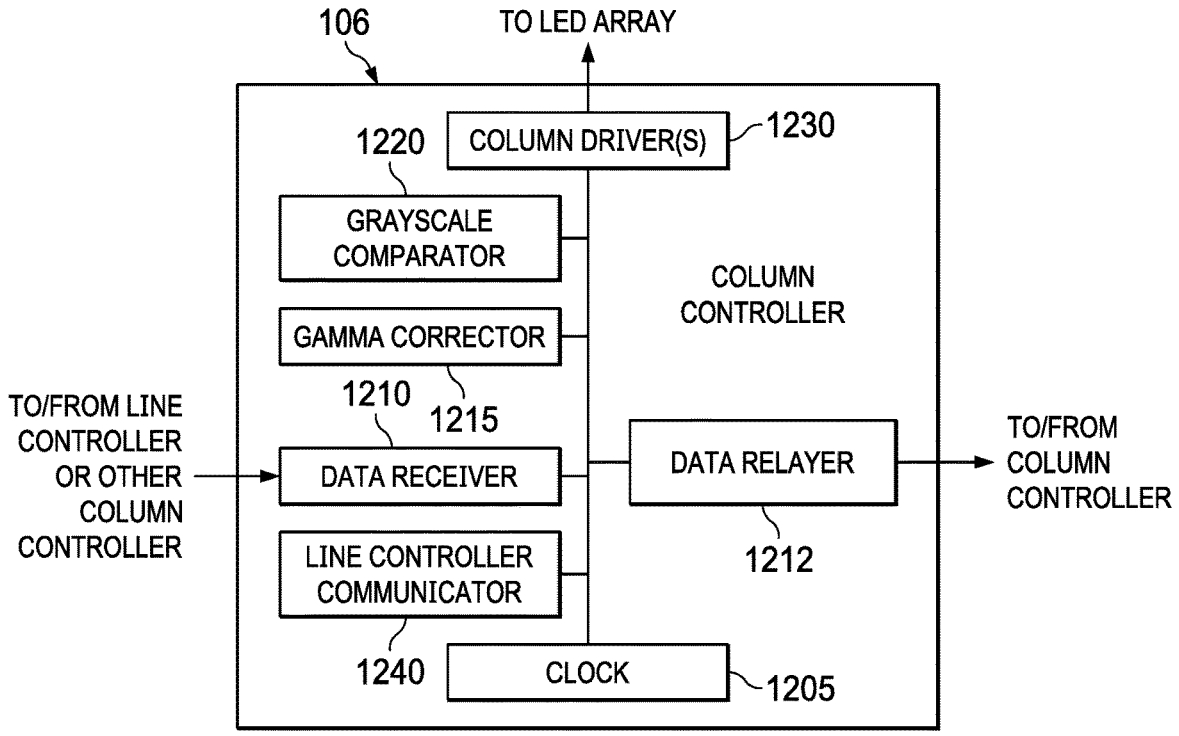
FIG. 12 is a block diagram of an example implementation of the example column controller of FIG. 1

FIG. 12 is a block diagram of an example implementation of the example column controller 106 of FIG. 1. The example column controller 106 of the illustrated example of FIG. 12 includes a clock 1205, a data receiver 1210, a data relayer 1212, a gamma corrector 1215, a grayscale comparator 1220, column driver(s) 1230, and a line controller communicator 1240.

The example clock 1205 of the illustrated example of FIG. 12 is implemented by a clock generator integrated circuit that outputs a clock signal for use in synchronizing operation of the components of the example column controller 106. In the illustrated example of FIG. 12, the clock 1205 is shown as an internal component of the column controller 106. However, in some examples, the clock 1205 may be implemented externally to the column controller 106 such that, for example, multiple different column controllers 106 may utilize a same clock signal (e.g., to synchronize operation across multiple column controllers 106).

The example data receiver 1210 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. The example data receiver 1210 receives data from the line controller 102 and/or another column controller (e.g., if the column controllers are arranged in a daisy-chain configuration). The example data receiver 1210 accesses data representing brightness values to be output by each of the LEDs of a particular row of the LED array 110 from the received data. The example data receiver 1210 determines a brightness values for the output channels. In examples disclosed herein, the brightness value is determined by parsing the received data.

The example data relayer 1212 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. The example data relayer 1212 relays the data (and/or a portion thereof) representing the brightness values to be output by each of the LEDs to another column controller. That is, the data relayer 1212 enables multiple column controllers to be arranged in a daisy chain configuration. While in some examples a daisy chain configuration is used, in some other examples the column controllers may be connected to a same bus, thereby alleviating the need for relaying data to other column controllers.

The example gamma corrector 1215 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. The example gamma corrector 1215 applies a gamma correction to the brightness values identified by the data receiver 1210 to create a grayscale values for each of the channels to be output. Applying a gamma correction enables a translation from a visual brightness to a grayscale value intended to cause the LED to output a level of brightness that, when perceived by a human, compensates for non-linearities in human perception of light.

The example grayscale comparator 1220 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. The example grayscale comparator 1220 of the illustrated example of FIG. 12 analyzes gamma corrected grayscale values output by the example gamma corrector 1215, and compares the grayscale values to various thresholds. In examples disclosed herein, based on the comparison of the grayscale values to the threshold(s), the example grayscale comparator 1220 directs the example column driver 1230 to output different corresponding waveforms. Example waveforms that may be output by the example column driver(s)

Figure 13A:
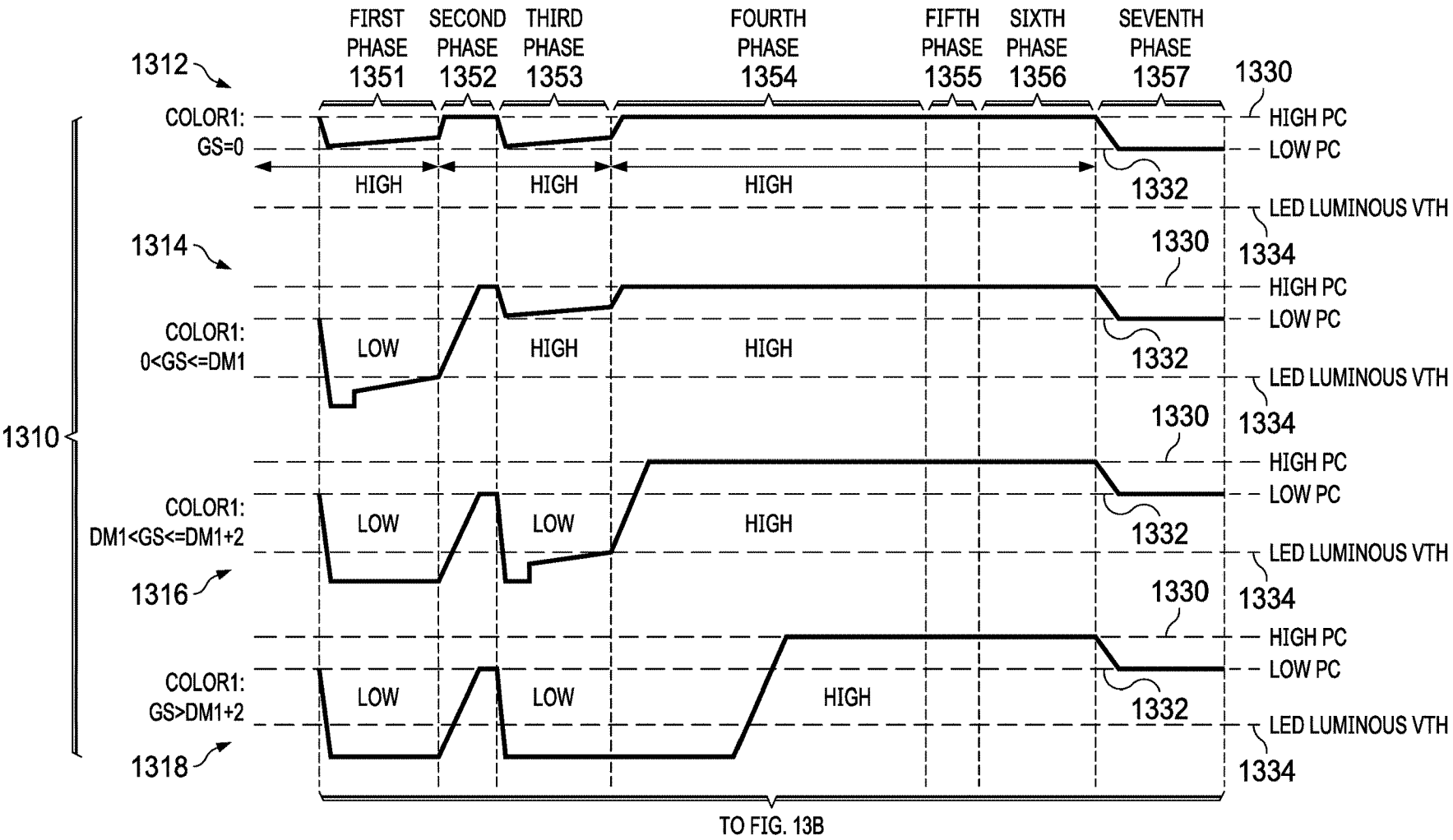
FIGS. 13A and 13B are timing diagrams representing example waveforms that may be output by the column controller of FIG. 12.

1230 based on the comparison performed by the example grayscale comparator 1220 are shown in greater detail in connection with FIGS. 13A and/or 13B. In examples disclosed herein, two different thresholds are used. However, any other number of threshold values used to select a waveform for output by the column driver(s) 1230 may additionally or alternatively be used.

The example column driver(s) 1230 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. In the illustrated example of FIG. 12, a single column driver is shown. However, in some examples, any number of column drivers maybe used corresponding to, for example, a number of columns of LEDs in the LED array 110 to be driven by the column controller 106. In examples disclosed herein, the example column driver 1230 outputs a voltage to control illumination of an LED. In some examples, the voltage is output as an analog voltage. However, in some other examples, the voltage is output using pulse width modulation.

The example line controller communicator 1240 of the illustrated example of FIG. 12 is implemented by a hardware logic circuit. However, any other type of circuitry may additionally or alternatively be used such as, for example, one or more analog or digital circuit(s), logic circuits, programmable processor(s), ASIC(s), PLD(s), FPLD(s), DSP(s), etc. In the illustrated example of FIG. 12, the line controller communicator 1240 indicates to the line controller 102 that the output of the values for the column by the column driver 1230 is complete. Such an indication enables the line controller 102 to move on to a subsequent line for illumination.

Figure 13B:
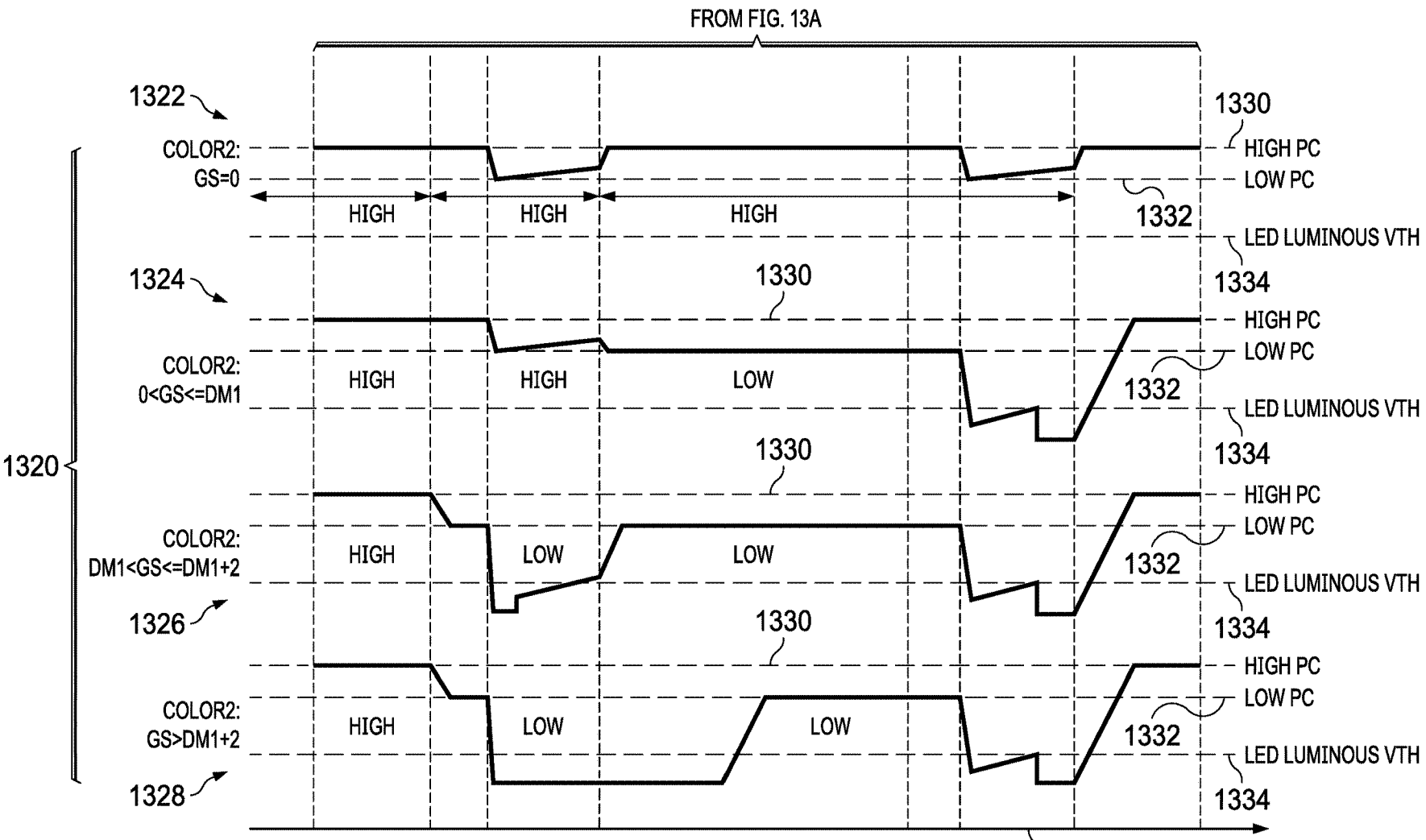

FIGS. 13A and/or 13B are timing diagrams representing example waveforms that may be output by the column controller 106 of FIG. 12. The example diagrams include a horizontal axis 1301. The vertical axis of the example diagrams of FIGS. 13A and/or 13B represent voltage. The vertical axis is illustrated as two sections 1310 (FIG. 13A) and 1320 (FIG. 13B), corresponding to output waveforms to be used for a first color (e.g., blue) and a second color (e.g., green), respectively.

The first section 1310 includes a first waveform 1312 corresponding to a waveform output by the example column driver 1230 to a first LED (e.g., an LED of the first color) when a grayscale value of the first LED is to be zero. A second waveform 1314 corresponds to a waveform output by the example column driver 1230 to the first LED when a grayscale value of the first LED is to be greater than zero and less than or equal to a first threshold. A third waveform 1316 corresponds to a waveform output by the example column driver 1230 to the first LED when a grayscale value of the first LED is to be greater than the first threshold and less than or equal to a second threshold. A fourth waveform 1318 corresponds to a waveform output by the example column driver 1230 to the first LED when a grayscale value of the first LED is to be greater than the second threshold.

The second section 1320 includes a fifth waveform 1322 corresponding to a waveform output by the example column driver 1230 to a second LED (e.g., an LED of the second color) when a grayscale value of the LED is to be zero. A sixth waveform 1324 corresponds to a waveform output by the example column driver 1230 to the second LED when a grayscale value of the second LED is to be greater than zero and less than or equal to the first threshold. A seventh waveform 1326 corresponds to a waveform output by the example column driver 1230 to the second LED when a grayscale value of the second LED is to be greater than the first threshold and less than or equal to the second threshold. A fourth waveform 1318 corresponds to a waveform output by the example column driver 1230 to the second LED when a grayscale value of the second LED is to be greater than the second threshold.

With respect to each of the waveforms 1312, 1314, 1316, 1318, 1322, 1324, 1326, 1328 a high pre-charge voltage 1330, a low pre-charge voltage 1332, and a LED luminous voltage 1334 are shown. In the illustrated example of FIGS. 13A and/or 13B, the waveforms are broken down into seven phases 1351, 1352, 1353, 1354, 1355, 1356, 1357. The first phase 1351 is referred to as a first Dummy 1 phase. The second phase 1352 is referred to as a pre-charge 1 (PC1) phase. The third phase 1353 is referred to as a Dummy 2 phase. The fourth phase 1354 is referred to as a pre-charge (PC) phase. The fifth phase 1355 is referred to as a pre-charge 2 (PC2) phase. The sixth phase 1356 is referred to as a second Dummy 1 phase. The seventh phase 1357 is referred to as a line change phase.

Example approaches disclosed herein recognize that low and medium brightness channels are sensitive for coupling, while high brightness channels do not result in user-perceivable coupling. In the illustrated example of FIGS. 13A and/or 13B, coupling effects are reduced for low grayscale situations by separating illumination of the first color 1310 and the second color 1320 into the first phase 1351 and the sixth phase 1356 (see the second waveform 1314 and the sixth waveform 1324). This temporal separation of the illumination of the first and second colors reduces any cross-color coupling effects. Moreover, when such illumination is taking place, other channels are left floating, thereby reducing any parasitic capacitance experienced at the load.

In the illustrated example of FIGS. 13A and/or 13B, coupling effects are reduced for medium grayscale situations (see the third waveform 1316 and the seventh waveform 1326). In the illustrated example of FIGS. 13A and/or 13B, the waveforms for the third waveform 1316 and the seventh waveform 1326 in the third phase 1353 are substantially the same. That is, each of the first color 1310 and the second color 1320 are illuminated for the substantially the same amount of time, ensuring that any tail charge effects and/or pre-charge effects are the same for the entire line, which results in any visible coupling effects.

While an example manner of implementing the example column controller 106 of FIG. 1 is illustrated in FIG. 12, one or more of the elements, processes and/or devices illustrated in FIG. 12 may be combined, divided, re-arranged, omitted, eliminated and/or implemented in any other way. Further, the example clock 1205, the example data receiver 1210, the example data relayer 1212, the example gamma corrector 1215, the example grayscale comparator 1220, the example column driver(s) 1230, the example line controller communicator 1240, and/or, more generally, the example column controller 106 of FIGS. 1 and/or 12 may be implemented by hardware, software, firmware and/or any combination of hardware, software and/or firmware. Thus, for example, any of the example clock 1205, the example data receiver 1210, the example data relayer 1212, the example gamma corrector 1215, the example grayscale comparator 1220, the example column driver(s) 1230, the example line controller communicator 1240, and/or, more generally, the example column controller 106 of FIGS. 1 and/or 12 could be implemented by one or more analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example clock 1205, the example data receiver 1210, the example data relayer 1212, the example gamma corrector 1215, the example grayscale comparator 1220, the example column driver(s) 1230, the example line controller communicator 1240, and/or, more generally, the example column controller 106 of FIGS. 1 and/or 12 is/are hereby expressly defined to include a non-transitory computer readable storage device or storage disk such as a memory, a digital versatile disk (DVD), a compact disk (CD), a Blu-ray disk, etc. including the software and/or firmware. Further still, the example column controller 106 of FIGS. 1 and/or 12 may include one or more elements, processes and/or devices in addition to, or instead of, those illustrated in FIG. 12, and/or may include more than one of any or all of the illustrated elements, processes and devices. As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

A flowchart representative of example hardware logic, machine readable instructions, hardware implemented state machines, and/or any combination thereof for implementing the example column controller 106 of FIG. 1 is shown in FIG. 12. The machine readable instructions may be an executable program or portion of an executable program for execution by a computer processor such as the processor 1812 shown in the example processor platform 1800 discussed below in connection with FIG. 18. The program may be embodied in software stored on a non-transitory computer readable storage medium such as a CD-ROM, a floppy disk, a hard drive, a DVD, a Blu-ray disk, or a memory associated with the processor 1812, but the entire program and/or parts thereof could alternatively be executed by a device other than the processor 1812 and/or embodied in firmware or dedicated hardware. Further, although the example program is described with reference to the flowchart illustrated in FIGS. 14, 15A, and/or 15B, many other methods of implementing the example column controller 106 may alternatively be used. For example, the order of execution of the blocks may be changed, and/or some of the blocks described may be changed, eliminated, or combined. Additionally or alternatively, any or all of the blocks may be implemented by one or more hardware circuits (e.g., discrete and/or integrated analog and/or digital circuitry, an FPGA, an ASIC, a comparator, an operational-amplifier (op-amp), a logic circuit, etc.) structured to perform the corresponding operation without executing software or firmware.

As mentioned above, the example processes of FIGS. 14, 15A, and/or 15B may be implemented using executable instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C.

Figure 14:
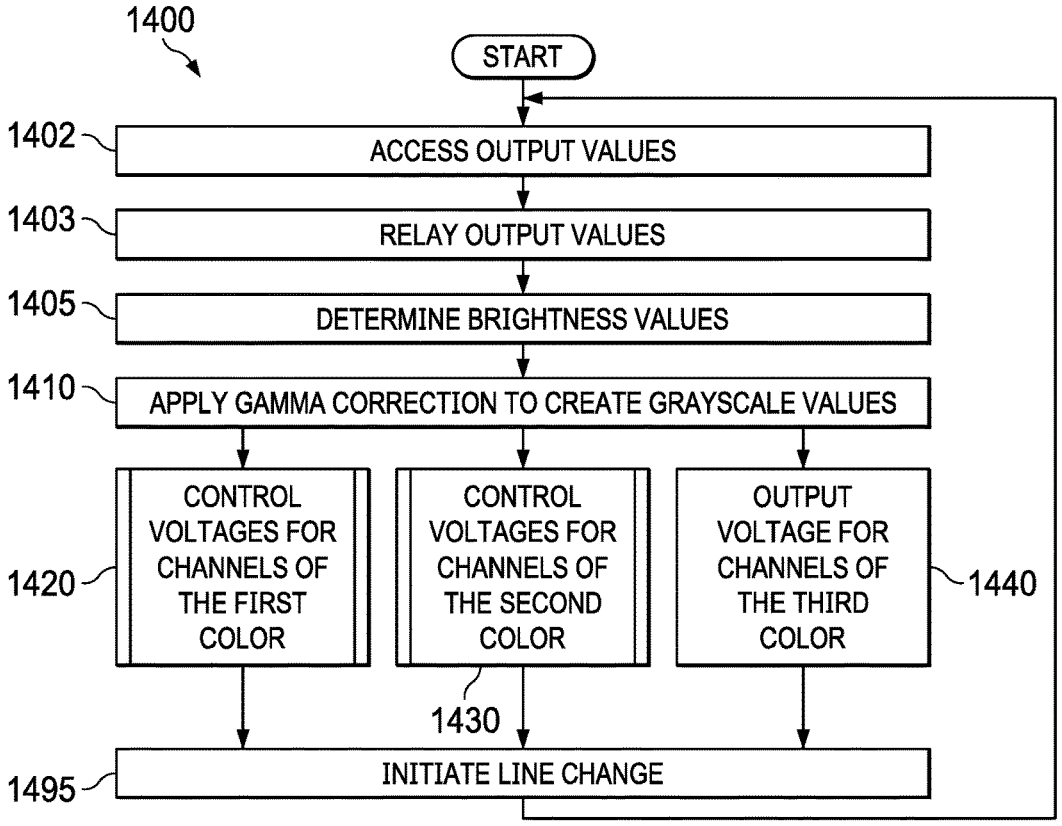
FIG. 14 is a flowchart representative of operations performed by the example column controller of FIGS. 1 and 12 to reduce coupling effects in a display.

FIG. 14 is a flowchart representative of operations performed by the example column controller 106 of FIGS. 1 and 12 to reduce coupling effects in a display. The process of FIG. 14 begins at block 1402 when the example data receiver 1210 accesses data representing brightness values to be output by each of the LEDs of a particular row of the LED array 110. (Block 1402). In examples disclosed herein, the data is received from the line controller 102 and/or another column controller. In some examples, the column controller 106 has a limited number of output channels (e.g., 48 channels corresponding to sixteen three color sets of LEDs). Thus, to achieve larger displays, additional column controllers may be used to output to additional columns of LEDs. The example data relayer 1212 relays the data (and/or a portion thereof) representing the brightness values to be output by each of the LEDs. (Block 1403).

The example data receiver 1210 determines a brightness values for the output channels. (Block 1405). In examples disclosed herein, the brightness value is determined by parsing the received data. In the illustrated example of FIG. 14, the channels are treated differently based on the color of the channel. That is, channels are grouped for handling based on the color of the corresponding LED. In examples disclosed herein, the first channel represents an LED of a first color (e.g., blue), the second channel represents an LED of a second color (e.g., green), and the third channel represents an LED of a third color (e.g., red). As described above, blue and green LEDs experience larger coupling effects and, as such, are handled differently than the red LED according to the processes described below in connection with FIGS. 15A and 15B.

The example gamma corrector 1215 then applies a gamma correction to the brightness values to create a grayscale values for each of the channels to be output. (block 1410). Applying a gamma correction enables a translation from a visual brightness to a grayscale value intended to cause the LED to output a level of brightness that, when perceived by a human, compensates for non-linearities in human perception of light.

The example column controller 106 then controls voltages of the LEDs for the selected line. In examples disclosed herein, LEDs of the first color, the second color, and the third color are handled differently to reduce coupling effects. In particular, the column controller 106 controls voltages for the channels of the first color (Block 1420), controls voltages for the channels of the second color (Block 1430), and controls voltages for the channels of the third color (Block 1440). An example approach to controlling the voltages of the channels of the first color (e.g., block 1420) is further described in connection with FIG. 15A. An example approach to controlling the voltages of the channels of the second color (e.g., block 1430) is further described in connection with FIG. 15B. At block 1440, the example column driver 1230 illuminates the third channel (e.g., a red LED) with a duration commensurate to the amount of brightness to be output.

The example line controller communicator 1240 then indicates to the line controller 102 that the output of the values for the column is complete and that a line change should occur. (Block 1495). Control proceeds to block 1402, where a subsequent line is then handled.

Figure 15A:
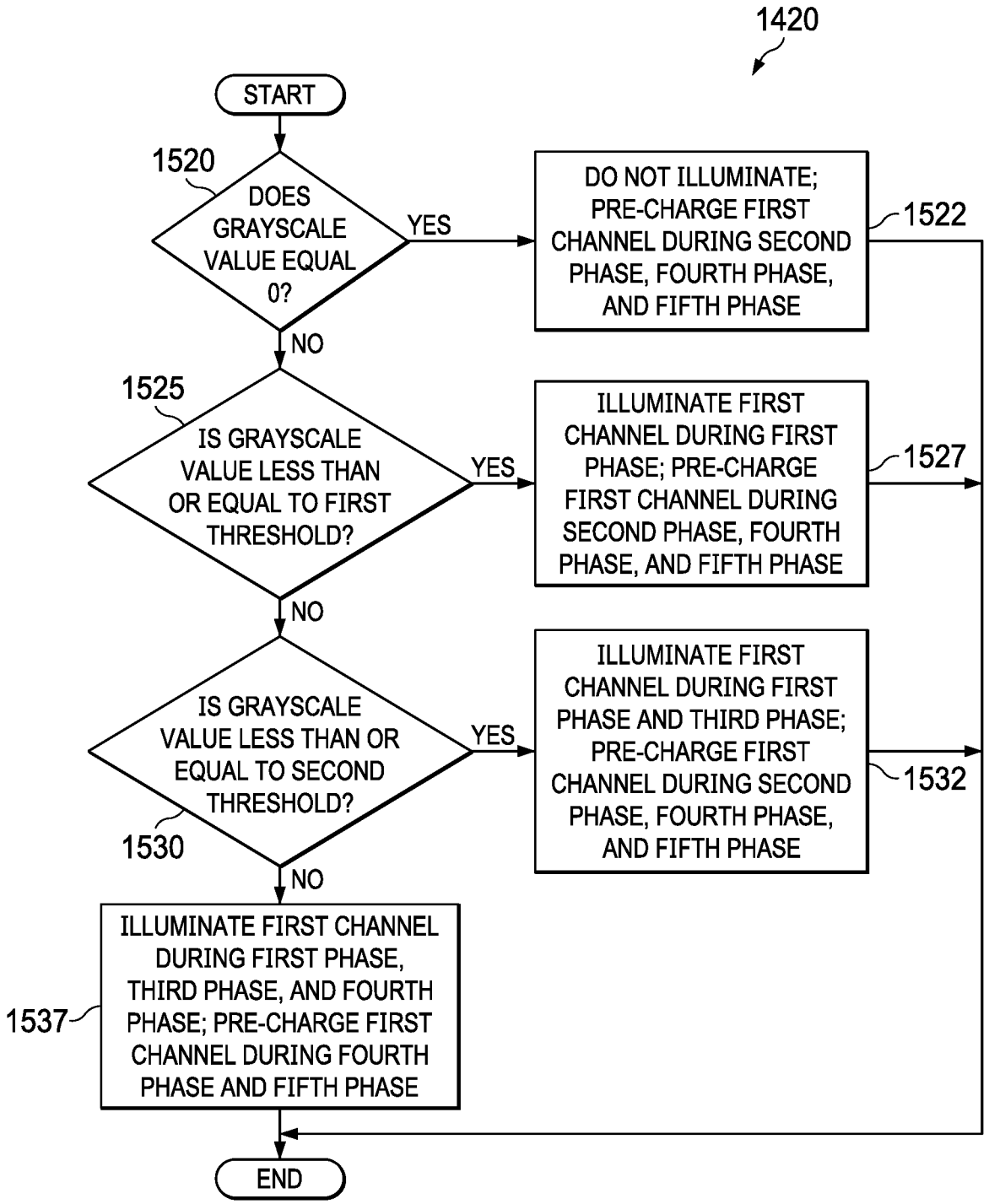
FIG. 15A is a flowchart representative of operations performed by the column controller to control voltages for channels of the first color (e.g., blue).

FIG. 15A is a flowchart representative of operations performed by the column controller 106 to control voltages for channels of the first color (e.g., blue). While in the illustrated example of FIG. 15A, a single output channel is controlled, the example process of FIG. 15A may be performed multiple times (e.g., in a serial fashion and/or in a parallel fashion) in connection with each of the output channels of the first color. The example process of FIG. 15A begins when the example grayscale comparator 1220 analyzes the grayscale value to determine whether the grayscale value is equal to zero. (Block 1520).

If the grayscale value is equal to zero (indicating that the first LED should not be illuminated) (e.g., block 1520 returns a result of YES), the example column driver(s) 1230 does not illuminate the first LED. (Block 1522). Further, the example column driver 1230 applies a pre-charging voltage the first channel during the second phase 1352, the fourth phase 1354, and the fifth phase 1355. During the first phase 1351, the third phase 1353, and the sixth phase 1356, the example column driver 1230 allows the first LED to float. In some examples, in addition to letting the first LED float during the first phase 1351 and the third phase 1353, the example column driver 1230 may apply a dummy one-shot function to charge the channel to a low pre-charge voltage (e.g., see line 1332 of the first waveform 1312 of FIG. 13A during the first phase 1351) and then let the channel float for the remainder of the first phase 1351 and/or third phase 1353.

If the grayscale value is not equal to zero (e.g., block 1520 returns a result of NO), the example grayscale comparator 1220 analyzes the grayscale value to determine whether the grayscale value is less than or equal to a first threshold. (Block 1525). If the grayscale value is less than or equal to the first threshold (e.g., block 1525 returns a result of YES), the example column driver 1230 illuminates the first channel during the first phase 1351 by applying a one-shot function to cause the voltage across the LED to drop below the luminous threshold 1334. (Block 1527)

Figure 16:
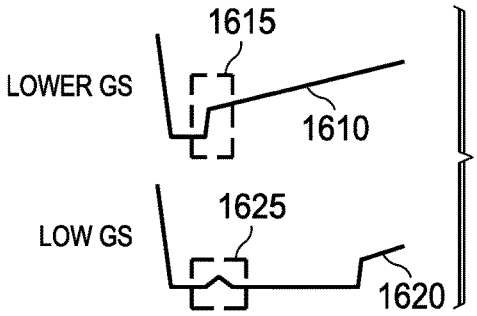
FIG. 16 is a diagram illustrating application of an adjustable up-one-shot function to a waveform.

In some examples, in addition to applying the one-shot function at the beginning of the first phase 1351, an adjustable up-one-shot function may be applied after an amount of time has elapsed after the initial one-shot function causes the LED to begin illumination. In examples disclosed herein, the adjustable up-one-shot function brings the voltage of the LED closer to the LED luminous threshold 1334. An example illustration of the adjustable up-one-shot function is shown in the illustrated example of FIG. 16. FIG. 16 includes a first waveform 1610 representing a voltage of a first channel over time, and a second waveform 1620 representing a voltage of a second channel over time. In the illustrated example of FIG. 16, an adjustable up-one-shot function 1615 is applied to the first waveform 1610. Because of the increased capacitance encountered across the line caused by the adjustable-up-one-shot function, the second waveform 1620 (which is still in conduction mode at the time of the application of the adjustable up-one-shot function to the first waveform 1610) experiences a voltage change 1625. The adjustable up-one-shot function mitigates the effects of the tail charge. However, because the adjustable up-one-shot function only brings the voltage up to the LED luminous threshold (and is not a complete pre-charge), the amount of disturbance effected onto other channels is minimized, thereby diminishing the overall coupling effect.

Returning to FIG. 15A, if the grayscale value is not less than or equal to the first threshold (e.g., block 1525 returns a result of NO), the example grayscale comparator 1220 analyzes the grayscale value to determine whether the grayscale value is less than or equal to a second threshold. (Block 1530). In examples disclosed herein, the second threshold is greater than the first threshold. If the grayscale value is less than or equal to the second threshold (e.g., block 1530 returns a result of YES), the example column driver 1230 illuminates the first channel during the first phase 1351 and the third phase 1353. (Block 1532). The example column driver 1230 applies a pre-charging voltage to the first channel during the second phase 1352, the fourth phase 1354, and the fifth phase 1355. In some examples, during the third phase 1353, the adjustable up-one-shot function (e.g., as described in connection with FIG. 16) is applied after an amount of time has elapsed after the initial one-shot function causes the LED to begin illumination. Application of the adjustable up-one-shot function enables control of the brightness of the LED (e.g., based on the time at which the function is applied), and also diminishes coupling effects (e.g., reduces the tail charge and impacts on other channels).

If the grayscale value is not less than or equal to the second threshold (e.g., block 1530 returns a result of NO), the example column driver 1230 illuminates the first channel during the first phase 1351, the third phase 1353, and the fourth phase 1354. (Block 1537). The example column driver 1230 applies a pre-charging voltage to the first channel during the fourth phase 1354 and the fifth phase 1355. In examples disclosed herein, the pre-charging applied during the fourth phase 1354 occurs upon an illumination duration (corresponding to the grayscale value) being reached after illuminating the first channel during the fourth phase 1354. The example process 1420 of FIG. 15A then terminates.

Figure 15B:
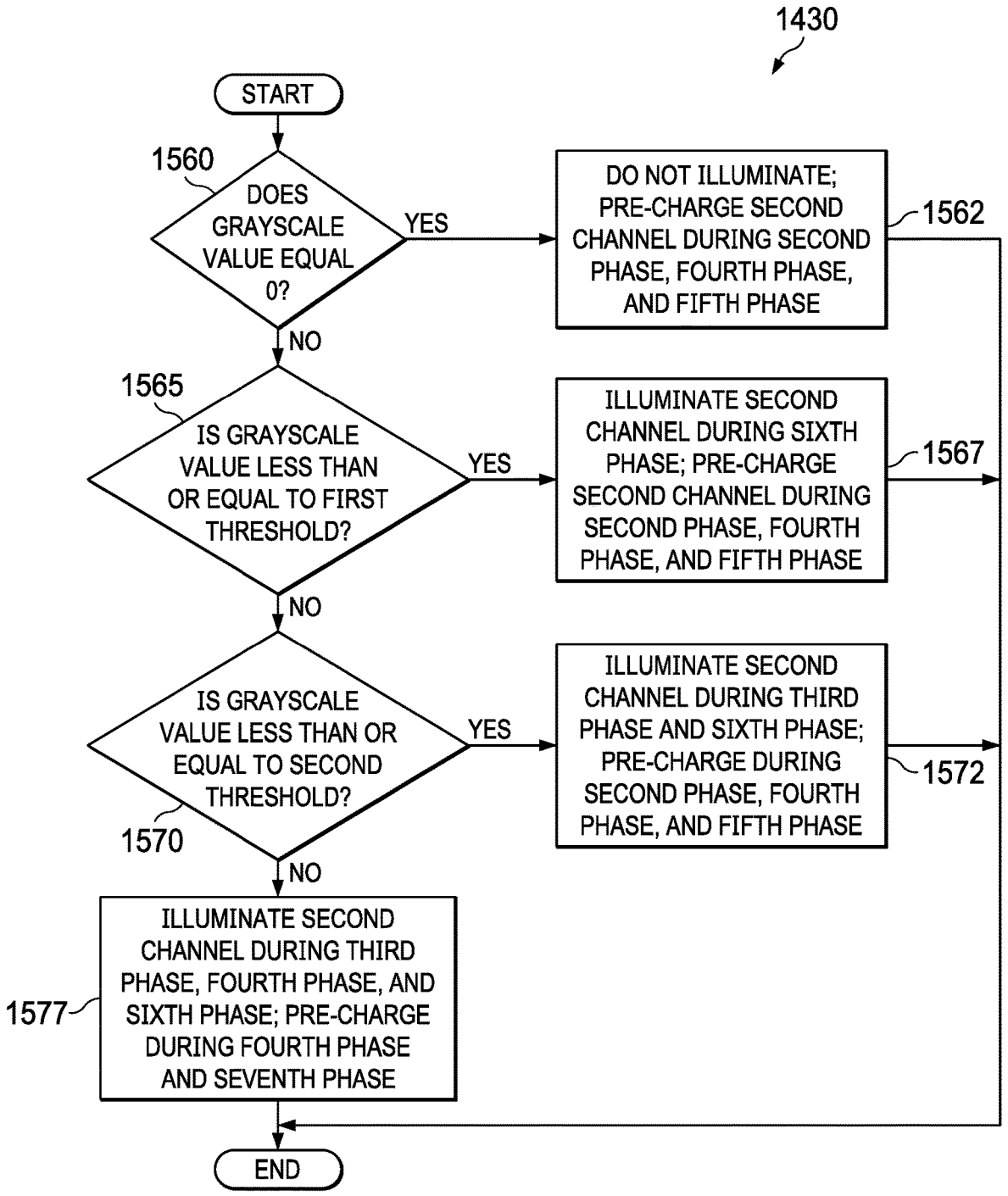
FIG. 15B is a flowchart representative of operations performed by the column controller to control voltages for channels of the second color (e.g., green).

FIG. 15B is a flowchart representative of operations performed by the column controller 106 to control voltages for channels of the second color (e.g., green). While in the illustrated example of FIG. 15B, a single output channel is controlled, the example process of FIG. 15B may be performed multiple times (e.g., in a serial fashion and/or in a parallel fashion) in connection with each of the output channels of the second color. The example process of FIG. 15B begins when the example grayscale comparator 1220 analyzes the grayscale value to determine whether the grayscale value is equal to zero. (Block 1560).

If the grayscale value is equal to zero (indicating that the second LED should not be illuminated) (e.g., block 1560 returns a result of YES), the example column driver(s) 1230 does not illuminate the first LED. (Block 1562). Further, the example column driver 1230 applies a pre-charging voltage the second channel during the second phase 1352, the fourth phase 1354, and the fifth phase 1355. During the first phase 1351, the third phase 1353, and the sixth phase 1356, the example column driver 1230 allows the second channel to float. In some examples, in addition to letting the second LED float during the third phase 1353 and the sixth phase 1356, the example column driver 1230 may apply a dummy one-shot function to charge the channel to a low pre-charge voltage (e.g., see line 1332 of the fifth waveform 1322 of FIG. 13B during the third phase 1353 and the sixth phase 1356) and then let the channel float for the remainder of the third phase 1353 and/or sixth phase 1356.

If the grayscale value is not equal to zero (e.g., block 1560 returns a result of NO), the example grayscale comparator 1220 analyzes the grayscale value to determine whether the grayscale value is less than or equal to the first threshold. (Block 1565). If the grayscale value is less than or equal to the first threshold (e.g., block 1565 returns a result of YES), the example column driver 1230 illuminates the second channel during the sixth phase 1356 by applying a one-shot function to cause the voltage across the LED to drop below the luminous threshold 1334. (Block 1567).

In some examples, in addition to letting the second LED float during the third phase 1353, the example column driver 1230 may apply a dummy one-shot function to charge the channel to a low pre-charge voltage (e.g., see line 1332 of the sixth waveform 1324 of FIG. 13B during the third phase 1353) and then let the channel float for the remainder of the third phase 1353.

Figure 17:
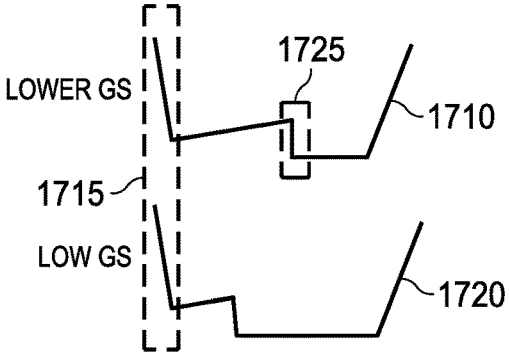
FIG. 17 is a diagram illustrating application of a delayed one-shot function to a waveform.

In some examples, to illuminate the LED during the sixth phase 1356, an initial one-shot function is applied to move the voltage across the LED to below the LED luminous threshold 1334, and the LED is held at a low brightness voltage until a delayed one-shot function is applied. An example illustration of this waveform is shown in further detail in FIG. 17. FIG. 17 includes a first waveform 1710 representing a voltage of a first channel over time, and a second waveform 1720 representing a voltage of a second channel over time. In the illustrated example of FIG. 17, the initial one-shot function 1715 is applied at the same time across all of the channels. Applying the one-shot function at the same time across all of the channels ensures that the one-shot function does not have any unintended coupling effects on other channels. However, doing so does produce a brighter coupling effect, while the LED is floating. After the application of the one-shot function, the LED is held at a low brightness voltage (potentially while dimly illuminated), until an amount of time is reached where the LED is to become fully illuminated. A final one-shot function 1725 is then applied, causing the LED to be then held at a fully illuminated voltage until an amount of time is reached where the LED is to be turned off, when a pre-charge voltage is applied, which causes the illumination of the LED to stop. The amount of time delay between the application of the initial one-shot function and the final one-shot function is based on the brightness value to be output by the LED. While the LED is held at the fully illuminated voltage, higher grayscale channels are conducting, and the loads of the lower grayscale channels are fixed. Because the lower grayscale channels are fixed, they are coupled darker. This coupling darker is offset by the coupling brighter when the LED is held at the low brightness voltage.

Returning to FIG. 15B, if the grayscale value is not less than or equal to the first threshold (block 1565 returns a result of NO), the example grayscale comparator 1220 analyzes the grayscale value to determine whether the grayscale value is less than or equal to a second threshold. (Block 1570). As noted above in connection with block 1530 of FIG. 15A, the second threshold is greater than the first threshold. If the grayscale value is less than or equal to the second threshold (block 1570 returns a result of YES), the example column driver 1230 illuminates the second channel during the third phase 1353 and the sixth phase 1356. (Block 1572). The example column driver 1230 applies a pre-charging voltage to the second channel during the second phase 1352, the fourth phase 1354, and the fifth phase 1355.

In some examples, during the third phase 1353, the adjustable up-one-shot function (e.g., as described in connection with FIG. 16) is applied after an amount of time has elapsed after the initial one-shot function causes the second LED to begin illumination. Application of the adjustable up-one-shot function enables control of the brightness of the LED (e.g., based on the time at which the function is applied), and also diminishes coupling effects (e.g., reduces the tail charge and impacts on other channels).

If the grayscale value is not less than or equal to the second threshold (e.g., block 1570 returns a result of NO), the example column driver 1230 illuminates the second channel during the third phase 1353, the fourth phase 1354, and the sixth phase 1356. (Block 1577). The example column driver 1230 applies a pre-charging voltage to the second channel during the fourth phase 1354 and the fifth phase 1355. In examples disclosed herein, the pre-charging voltage applied during the fourth phase 1354 occurs upon an illumination duration (corresponding to the grayscale value) being reached after illuminating the second channel during the fourth phase 1354. The example process 1430 of FIG. 15B then terminates.

Figure 18:
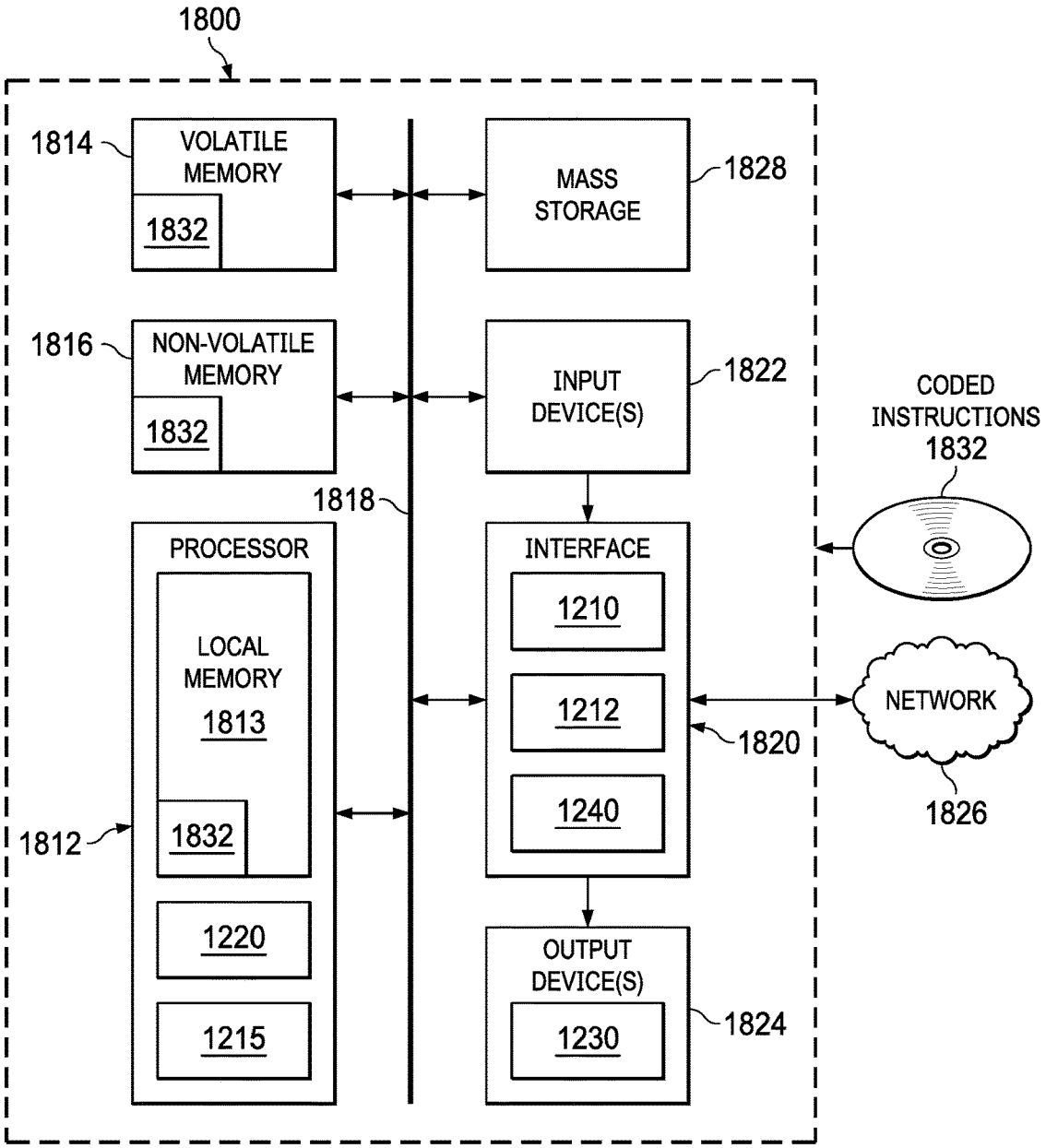
FIG. 18 is a block diagram of an example processor platform structured to execute the instructions of FIGS. 14, 15A, and/or 15B to implement the example column controller of FIGS. 1 and/or 12.

FIG. 18 is a block diagram of an example processor platform 1800 structured to execute the instructions of FIGS. 14, 15A, and/or 15B to implement the example column controller 106 of FIGS. 1 and/or 12. The processor platform 1800 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset or other wearable device, or any other type of computing device.

The processor platform 1800 of the illustrated example includes a processor 1812. The processor 1812 of the illustrated example is hardware. For example, the processor 1812 can be implemented by one or more integrated circuits, logic circuits, microprocessors, GPUs, DSPs, or controllers from any desired family or manufacturer. The hardware processor may be a semiconductor based (e.g., silicon based) device. In this example, the processor implements the example grayscale comparator 1220, and the example gamma corrector 1215.

The processor 1812 of the illustrated example includes a local memory 1813 (e.g., a cache). The processor 1812 of the illustrated example is in communication with a main memory including a volatile memory 1814 and a non-volatile memory 1816 via a bus 1818. The volatile memory 1814 may be implemented by Synchronous Dynamic Random Access Memory (SDRAM), Dynamic Random Access Memory (DRAM), RAMBUS® Dynamic Random Access Memory (RDRAM®) and/or any other type of random access memory device. The non-volatile memory 1816 may be implemented by flash memory and/or any other desired type of memory device. Access to the main memory 1814, 1816 is controlled by a memory controller.

The processor platform 1800 of the illustrated example also includes an interface circuit 1820. The interface circuit 1820 may be implemented by any type of interface standard, such as an Ethernet interface, a universal serial bus (USB), a Bluetooth® interface, a near field communication (NFC) interface, and/or a PCI express interface.

In the illustrated example, one or more input devices 1822 are connected to the interface circuit 1820. The input device(s) 1822 permit(s) a user to enter data and/or commands into the processor 1812. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 1824 are also connected to the interface circuit 1820 of the illustrated example. The output devices 1824 can be implemented, for example, one or more transistors driving display devices (e.g., a light emitting diode (LED), an organic light emitting diode (OLED), etc.). The interface circuit 1820 of the illustrated example, thus, may be referred to as a graphics driver card, a graphics driver chip, and/or a graphics driver processor.

The interface circuit 1820 of the illustrated example also includes a communication device such as a transmitter, a receiver, a transceiver, a modem, a residential gateway, a wireless access point, and/or a network interface to facilitate exchange of data with external machines (e.g., computing devices of any kind) via a network 1826. The communication can be via, for example, an Ethernet connection, a digital subscriber line (DSL) connection, a telephone line connection, a coaxial cable system, a satellite system, a line-of-site wireless system, a cellular telephone system, etc.

The processor platform 1800 of the illustrated example also includes one or more mass storage devices 1828 for storing software and/or data. Examples of such mass storage devices 1828 include floppy disk drives, hard drive disks, compact disk drives, Blu-ray disk drives, redundant array of independent disks (RAID) systems, and digital versatile disk (DVD) drives.

The machine executable instructions 1832 of FIGS. 14, 15A, and/or 15B may be stored in the mass storage device 1828, in the volatile memory 1814, in the non-volatile memory 1816, and/or on a removable non-transitory computer readable storage medium such as a CD or DVD.

From the foregoing, it will be appreciated that example methods, apparatus and articles of manufacture have been disclosed that reduce the effects of coupling across a line of LEDs in an LED array.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A controller to reduce a coupling effect of illuminating a row of light emitting diodes (LEDs), the controller comprising:

a comparator adaptable to compare a grayscale value for a first LED to a first threshold and compare a second grayscale value for a second LED to the first threshold, the first LED having a different color from the second LED;

a plurality of drivers adaptable to illuminate the first LED during a first time period responsive to the comparator determining that the grayscale value of the first LED is less than the first threshold and illuminating the second LED during a second period responsive to the comparator determining that the grayscale value of the second LED is less than the first threshold value; and wherein the first time period is different than the second time period.

2. The controller of claim 1, wherein the plurality of drivers includes a first driver to drive the first LED and a second driver to drive the second LED.

3. The controller of claim 2, wherein the plurality of drivers further includes a third driver to drive a third LED, the third LED having a different color from the first LED and the second LED.

4. The controller of claim 3, wherein the first LED is a blue LED, the second LED is a green LED, and the third LED is a red LED.

5. The controller of claim 1, further including a gamma corrector to apply a gamma correction to the grayscale value of the first LED, wherein the comparator is to compare the gamma corrected grayscale value of the first LED to the first threshold.

6. The controller of claim 1, wherein, to cause the first LED to be illuminated, a first driver of the plurality of drivers is to apply a one-shot function to cause the first LED to become illuminated, delay an amount of time based on the grayscale value of the first LED, and apply an adjustable up-one-shot function to cause a voltage across the first LED to approach an LED luminous threshold.

7. The controller of claim 6, wherein the voltage across the first LED is less than the LED luminous threshold during the up-one-shot function.

8. The controller of claim 1, wherein, to cause the second LED to be illuminated, a first driver of the plurality of drivers is to apply an initial one-shot function to cause the second LED to become dimly illuminated, delay an amount of time based on the grayscale value of the second LED, apply a second one-shot function to cause the second LED to become fully illuminated, and apply a pre-charge voltage to cause the illumination of the second LED to stop.

9. A light emitting diode (LED) display comprising:

an array of LEDs including one or more lines of LEDs;

a line controller to select a line of LEDs to be illuminated, the line of LEDs including a first LED and a second LED; and a column controller adaptable to:

compare a grayscale value for the first LED to a threshold;

compare a grayscale value for the second LED to a threshold;

illuminate the first LED during a first time period in response to the comparison of the grayscale value of the first LED to the threshold; and illuminate the second LED during a second time period different than the first time period in response to the comparison of the grayscale value of the second LED to the threshold.

10. The LED display of claim 9, wherein the column controller is to allow voltage applied to the second LED to float during the first time period.

11. The LED display of claim 9, wherein the line of the LEDs includes a first set of LEDs and a second set of LEDs, the column controller is a first column controller that controls the illumination of the first set of LEDs, and further including:

a second column controller to control illumination of the second set of LEDs in the line of LEDs.

12. The LED display of claim 11, wherein the first column controller further includes a data relayer to relay grayscale values to the second column controller.

13. The LED display of claim 9, wherein, to cause the first LED to be illuminated, the column controller is to apply a one-shot function to cause the first LED to become illuminated, delay an amount of time based on the grayscale value of the first LED, and apply an adjustable up-one-shot function to cause a voltage across the first LED to approach an LED luminous threshold.

14. The LED display of claim 13, wherein the voltage across the first LED is less than the LED luminous threshold during the up-one-shot function.

15. The LED display of claim 9, wherein, to cause the second LED to be illuminated, the column controller is to apply an initial one-shot function to cause the second LED to become dimly illuminated, delay an amount of time based on a grayscale value, apply a final one-shot function to cause second LED to become fully illuminated for a period of time based on the grayscale value, and apply a pre-charge voltage to stop the illumination of the second LED.

16. A method of reducing a coupling effect in a plurality of light emitting diodes (LEDs), the method comprising:

accessing a first brightness value for a first LED and a second brightness value for a second LED, the first LED having a different color from the second LED;

comparing the first brightness value to a threshold;

comparing the second brightness value to the threshold; and causing, responsive to the first brightness value being less than the threshold and the second brightness value being less than the threshold, the first LED to be illuminated during a first time period and the second LED to be illuminated during a second time period, the first time period different from the second time period.

17. The method of claim 16, further including applying a gamma correction to the first brightness value, wherein the comparison of the first brightness value is based on the gamma correction applied to the first brightness value.

18. The method of claim 16, wherein the causing of the first LED to be illuminated during the first time period includes:

applying a one-shot function to cause the first LED to become illuminated;

delaying an amount of time based on the first brightness value; and applying an adjustable up-one-shot function to cause a voltage across the first LED to approach an LED luminous threshold.

19. The method of claim 18, wherein the applying of the adjustable up-one-shot function does not cause the voltage across the first LED to surpass the LED luminous threshold.

20. The method of claim 16, wherein the causing of the second LED to be illuminated during the second phase includes:

applying an initial one-shot function to cause the second LED to become dimly illuminated;

delaying an amount of time based on the second brightness value;

applying a second one-shot function to cause second LED to become fully illuminated; and applying a pre-charge voltage to cause the illumination of the second LED to stop.

21. The method of claim 16, further including:

accessing a third brightness value for a third LED, the third LED having a different color from the first LED and the second LED; and causing a third LED to be illuminated for an amount of time based on the third brightness value.

22. The method of claim 21, wherein the first LED is a blue LED, the second LED is a green LED, and the third LED is a red LED.

* * * * *